US007234694B2

(12) United States Patent
Richter et al.

(10) Patent No.: US 7,234,694 B2
(45) Date of Patent: Jun. 26, 2007

(54) SADDLE STITCHER INCLUDING CARD GLUERS FOR DISPENSING PERSONALIZED PRINTED CARDS AND METHOD THEREFOR

(75) Inventors: Lutz Richter, Schkeuditz (DE); Andreas Steinert, Beucha (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 270 days.

(21) Appl. No.: 10/968,382

(22) Filed: Oct. 19, 2004

(65) Prior Publication Data

US 2005/0082733 A1 Apr. 21, 2005

(30) Foreign Application Priority Data

Oct. 21, 2003 (DE) ..... 103 49 483

(51) Int. Cl.
*B42B 9/06* (2006.01)

(52) U.S. Cl. ..... 270/52.26; 270/52.14; 270/52.16; 270/52.18; 270/52.29; 412/8

(58) Field of Classification Search ..... 270/52.14, 270/52.16, 52.26, 52.29; 412/8
See application file for complete search history.

(56) References Cited

U.S. PATENT DOCUMENTS 4,917,367 A 4/1990 Sterne et al.
5,114,128 A * 5/1992 Harris et al. ..... 270/1.03
5,569,012 A * 10/1996 Kosasa et al. ..... 412/33
5,657,978 A 8/1997 Meier et al.
5,988,620 A * 11/1999 Graushar ..... 270/1.02
2002/0043753 A1 4/2002 Richter et al.
2006/0097439 A1* 5/2006 Langenegger ..... 270/52.16

FOREIGN PATENT DOCUMENTS

| | | | |
|---|---|---|---|
| EP | 0 422 257 | A1 | 4/1991 |
| EP | 0 672 603 | B1 | 9/1995 |
| EP | 0 917 965 | B1 | 5/1999 |
| EP | 0 997 421 | A1 | 5/2000 |
| EP | 1 156 003 | A2 | 11/2001 |
| JP | 2001-001665 | A | 1/2001 |

* cited by examiner

*Primary Examiner*—Gene O. Crawford
*Assistant Examiner*—Leslie A. Nicholson, III
(74) *Attorney, Agent, or Firm*—Keating & Bennett, LLP

(57) ABSTRACT

A saddle stitcher for producing personalized saddle stitched brochures includes a stitching station, at least two folded sheet feeders for the feeding of nonpersonalized folded sheets, an assembly chain, a drive system, and at least two card gluers arranged along the assembly chain which glue personalized printed matter onto the nonpersonalized folded sheets.

21 Claims, 6 Drawing Sheets

SADDLE STITCHER INCLUDING CARD GLUERS FOR DISPENSING PERSONALIZED PRINTED CARDS AND METHOD THEREFOR

BACKGROUND OF THE INVENTION

1. Field of the Invention

The present invention relates to a saddle stitcher for folded sheets including a stitching station, at least one folded sheet feeder, an assembly chain, a drive unit, and at least two card gluers along the assembly chain for dispensing personalized printed matter onto the folded sheets on the assembly chain.

2. Description of the Related Art

Saddle stitchers are paper processing machines with which an end product, such as a brochure, is assembled from several folded sheets that are stitched together. Printed folded sheets are disposed in folded sheet feeders so as to be lying or standing on their backs in stacks. Subsequently, the printed folded sheets are separated from each other, opened up and placed on the assembly chain. The folded sheets to be stitched are gathered and lined up on the assembly chain by pushers. The assembly chain transports the assembled folded sheets to the stitching station, where they are stapled together by stitching heads. A trimmer is usually provided to cut off the edge of the stitched product, from which the end product is further transported to a delivery. A conventional saddle stitcher is disclosed in European Patent EP 917 965 B1.

However, the mere assembling of folded sheets into a brochure is often not sufficient to make a printed product commercially attractive. There is a demand for a saddle stitcher that provides an added value to the printed product. This added value arises, for example, from additional processing steps that are performed on the folded sheets during assembly. One way to create added value is to enclose additional elements with the printed product, such as samples of goods like perfume or cream, or advertising cards. It is especially favorable to address the reader personally, either because he is known from having subscribed to the printed product or because it is a mass mailing campaign. The additional personalization can be accomplished, for example, by a glue-on advertising card, which is printed with the name and address by a digital printing device for a particular group of customers and glued at a particular place in the printed product at a saddle stitcher. Such product sample gluers or card gluers are known in the art.

SUMMARY OF THE INVENTION

To improve upon the conventional devices described above, preferred embodiments of the present invention provide a saddle stitcher that produces an assembled product having an added value by performing additional processing steps for the folded sheets during the assembly, and a method therefor.

In the present application, printed matter means all materials and surfaces on which a personalization can be placed, such as paper, carton, foil, plastic or textile fabric. The surfaces can also include packages of other materials, such as an envelope or even a container for cosmetics or other substances or a data medium, such as a CD. It would also be conceivable to store the personalized data digitally on a data medium and the printed matter serves only as packaging for the personalized digital data medium and may itself not be personalized. The personalized printed matter glued in an individual printed product forms a set. Within the set, different personalized printed matter may be provided. The individual sets may also include differing numbers of personalized printed matter.

In one preferred embodiment of the present invention, a drive unit of a saddle stitcher includes several individual drive units. Preferably, each individual drive unit includes at least one electric motor and one controller assigned thereto, and an electrical connection for the exchange of data and/or control signals between the controllers. Preferably, each of the folded sheet feeders, the stitching station, and the assembly chain has an individual drive unit. As an alternative, the stitching station and the assembly chain may include a single individual drive unit.

By providing individual drive units with their own synchronous, induction, or DC motor, the saddle stitcher can be expanded by any desired number of folded sheet feeders and card gluers. The exchanging of data and/or control signals between the controllers ensures synchronized operation of the individual components of the saddle stitcher. The rotary position offset of individual components is easily changed during the operation of the saddle stitcher. The switching of folded sheet feeders and card gluers between two saddle stitchers is greatly facilitated.

The connection for exchanging data and/or control signals is preferably a field bus. The use of a bus line enables bidirectional data transfer between the individual components of the saddle stitcher. The saddle stitcher can be expanded to include additional individual folded sheet feeders, card gluers or other components, such as label dispensers, by simply connecting the controllers to the field bus, without having to provide additional cable connections.

Preferably, at least one controller includes a stored program control and/or a motor control. The stored program has a flexible and user-friendly configuration such that all components of the saddle stitcher can easily be adapted to different operating conditions, such as different production speeds and paper grades. The motor control, on the other hand, requires a processing speed which enables real-time control of the motor.

Each motor control preferably includes a motor controller, a bus interface, an input/output unit and a motor control end stage. The motor controller is preferably a microcontroller including a microprocessor. The motor control end stage is required as the power component for actuating the motor.

At least one individual drive unit is provided with an operator display station. Thus, the individual drive unit can be manually adjusted on site, or an automatic set-up and the current operating parameters may be displayed locally.

Finally, the folded sheet feeders and/or at least one of the card gluers are preferably arranged at approximately 180 degrees relative to the assembly chain. In such a hybrid operation including the feeding of folded sheets, rod type feeders are preferably used. As a result, the personalized printed matter can be provided in various locations of the folded sheets. Thus, the configuration of the saddle stitcher is flexible and can easily be adapted to existing space conditions. By reducing the speed of certain individual drive units via an electronic transmission, any desired speed reduction can be achieved, such that any desired type of operation can be performed, such as 1:1, 1:2, 1:3, and 1:4, for example.

In another preferred embodiment of the present invention, the folded sheet feeders and/or at least one of the card gluers include a moving mechanism which enables the folded sheet feeders and/or at least one of the card gluers to be shifted and secured. In this manner, the location of the individual units can be quickly changed.

In another preferred embodiment of the present invention, at least one card gluer is provided at each feeder location of the saddle stitcher. Since the card gluers and the feeders are disposed along the assembly chain, personalized printed matter can be dispensed between any two adjacent feeders. Otherwise, the next folded sheet will have already been disposed on the preceding folded sheet and the preceding folded sheet will no longer be accessible for dispensing the personalized printed matter. With the configuration in which the card gluers can be placed anywhere along the assembly chain, it is possible to dispense one or more personalized printed matter on any folded sheet that is desired.

In another preferred embodiment of the present invention, the card gluers are synchronized with the drive of the saddle stitcher via the connection for the exchange of data and/or control signals. In this manner, the personalized printed matter is accurately and uniformly located on the folded sheet. Preferably, the controller of the individual drive units of the card gluers is configured such that the speeds of the card gluers are adjusted to speed changes of the saddle stitching.

In another preferred embodiment of the present invention, the controllers of the individual drive units of the card gluers are configured such that the dispensing location of the personalized printed matter on the folded sheet can be adjusted and fine-tuned by a controlled rotary angle offset. In this manner, corrections can be performed, even during the actual operation of the saddle stitcher, to improve the appearance of the finished printed product.

In another preferred embodiment of the present invention, the controller of the saddle stitcher sequentially monitors the feeders and the card gluers. Sequential feeder monitoring is defined herein as a process in which the controller of each folded sheet feeder informs at least the controllers of all following folded sheet feeders along the assembly chain about the dropping of the folded sheet, in particular whether the folded sheet was correctly dropped and no bad sheets or double sheets were produced. In this case, the controllers of the following folded sheet feeders and the controllers of the following card gluers are prevented from dropping additional folded sheets or gluing on personalized printed matter on defective products which will be rejected.

In addition, the stitching apparatus is preferably informed by the sequential feeder monitoring, so as to prevent defective products from being stitched. The folded sheets that have been assembled are then simply taken apart again and returned to the proper folded sheet feeders. Preferably, the control system keeps track of which customers have not been personalized, i.e., which assembled folded sheets have been rejected, such that a printed product can be prepared afterwards for these customers. It is advantageous at this time to retrieve the personalized printed matter from the work flow of printed products, to be used afterwards to provide a complete printed product with the relevant personalized printed matter, without having to print out the personalized data again.

In another preferred embodiment of the present invention, the card gluers are configured such that at least one personalized printed matter can be dispensed on the front side and the back side of each signature of a brochure.

In another preferred embodiment of the present invention, the saddle stitcher preferably includes a central controller. Preferably, this central controller is connected to the controllers of the individual drive units for exchanging data and/or control signals. Preferably, the central controller of the saddle stitcher actuates the card gluers such that all cards glued into each brochure are identically personalized.

In another preferred embodiment of the present invention, a controller is provided behind each card gluer, by which the gluing of each personalized printed matter is monitored. In addition, a reject device is preferably provided, by which brochures which do not include a card are rejected. In this manner, the above-described advantages of the sequential feeder monitoring are effectively achieved.

According to another preferred embodiment of the present invention, a method for making of personalized saddle stitched brochures is provided which includes the steps of (a) feeding a nonpersonalized folded sheet via a folded sheet feeder, (b) placing an opened sheet on the assembly chain, (c) activating a card gluer, if personalized printed matter is to be glued onto the sheet, (d) checking whether the personalized printed matter has been glued on the sheet, (e) feeding another nonpersonalized sheet via another folded sheet feeder, (f) placing the other sheet on the assembly chain, (g) activating another card gluer, if a personalized printed matter is to be glued onto the other sheet, (h) checking whether this other personalized printed matter has been glued on the other sheet, repeating steps e) to h) until a complete personalized brochure is assembled, and saddle stitching of the complete personalized brochure.

In another preferred embodiment of the preferred embodiment, the saddle stitched brochure is cut on three sides after the step of saddle stitching.

The method preferably includes the additional steps, after each gluing of a personalized printed matter, of checking whether the personalized printed matter has been glued on the respective sheet and rejecting the sheet if the personalized printed matter has not been glued on the respective sheet. In this manner, defective personalized printed products are prevented from undergoing further process steps, and the sheets already assembled can be reused. In addition, the defective personalized brochure is preferably identified, such that an additional personalized brochure can be produced for the particular personalized recipient.

The method preferably includes an additional step of checking to ensure that only identically personalized printed matter has been glued into a brochure. In this manner, the method ensures that the personalized printed matter has been glued at each desired location and that all glued personalized printed matter pertains to the same recipient. This prevents misplacement of the individual card gluers, which could result in a mixing up of the recipients on the individual personalized printed matter in a printed product. Preferably, a readable index is provided on the personalized printed matter, which is compared by the control system to electronically memorized information from, for example, a corresponding database. The readable index may be, for example, a bar code. Preferably, when the control system determines that printed products include wrongly personalized printed matter having different personalizations, the brochure is rejected. In another preferred embodiment, the personalized printed matter is not glued into the brochure when wrongly personalized printed matter is detected.

Preferably, the card gluers at the saddle stitcher will be operated such that the correct make-up of the personalization will be restored once an error has occurred. For example, if the third card gluer skips a personalized printed matter in its stack, the third card gluer will discard its lowermost card, so as to be synchronized with the other card gluers.

Other features, elements, steps, characteristics and advantages of the present invention will become more apparent from the following detailed description of preferred embodiments with reference to the attached drawings.

DETAILED DESCRIPTION OF PREFERRED EMBODIMENTS

Figure 1:
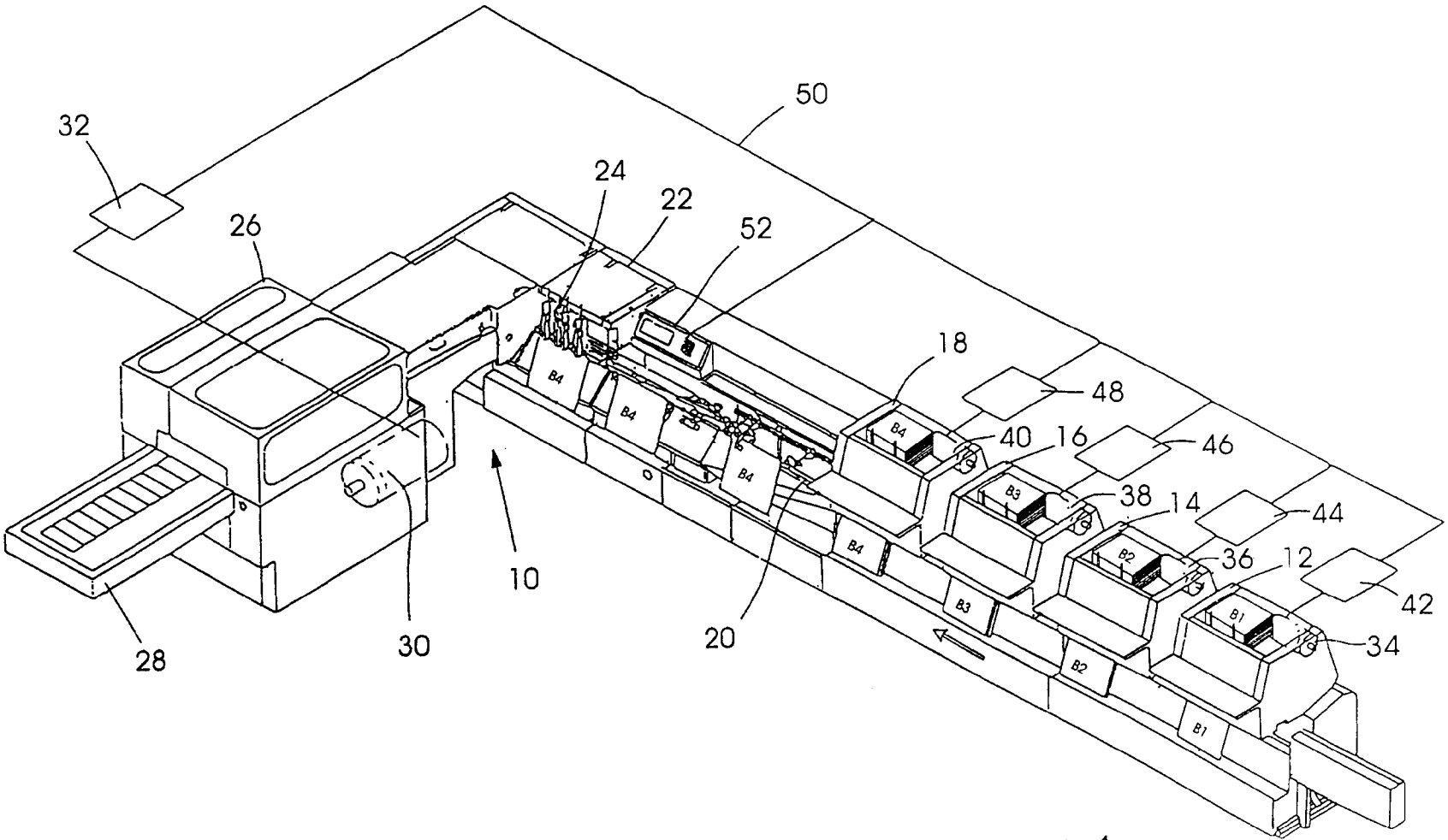
Fig. 1 Prior Art
FIG. 1 is a perspective view of a saddle stitcher including a schematic representation of the drive system.

FIG. 1 shows a saddle stitcher 10 which can be outfitted with a card gluer according to preferred embodiments of the present invention. This saddle stitcher 10 preferably includes four folded sheet feeders 12, 14, 16 and 18, each of which places a single folded sheet on an assembly chain 20. The assembly chain 20 gathers the individual folded sheets B1, B2, B3 and B4 and transports them to the stitching station 22. The stitching heads 24 arranged at the stitching station 22 stitch the folded sheets B1 to B4, which are lying one on top of the other. From the stitching station 22, the stitched folded sheets are fed to the trimmer 26, where the edges of the stitched folded sheets are cut. From the trimmer 26, the finished end products, such as brochures, are fed to the delivery 28.

The drive system of the saddle stitcher 10 includes a main unit having an electric motor 30 and a controller 32. The electric motor 30 drives the assembly chain 20, the stitching station 22, and the trimmer 26. The folded sheet feeders 12, 14, 16 and 18 have individual secondary units including an electric motor 34, 36, 38, and 40 and a coordinated controller 42, 44, 46 and 48. The main unit and the secondary units are connected to one another via a field bus 50. A central operator station 52 including a display unit and a keyboard or input device is also connected to the field bus 50.

Figure 2:
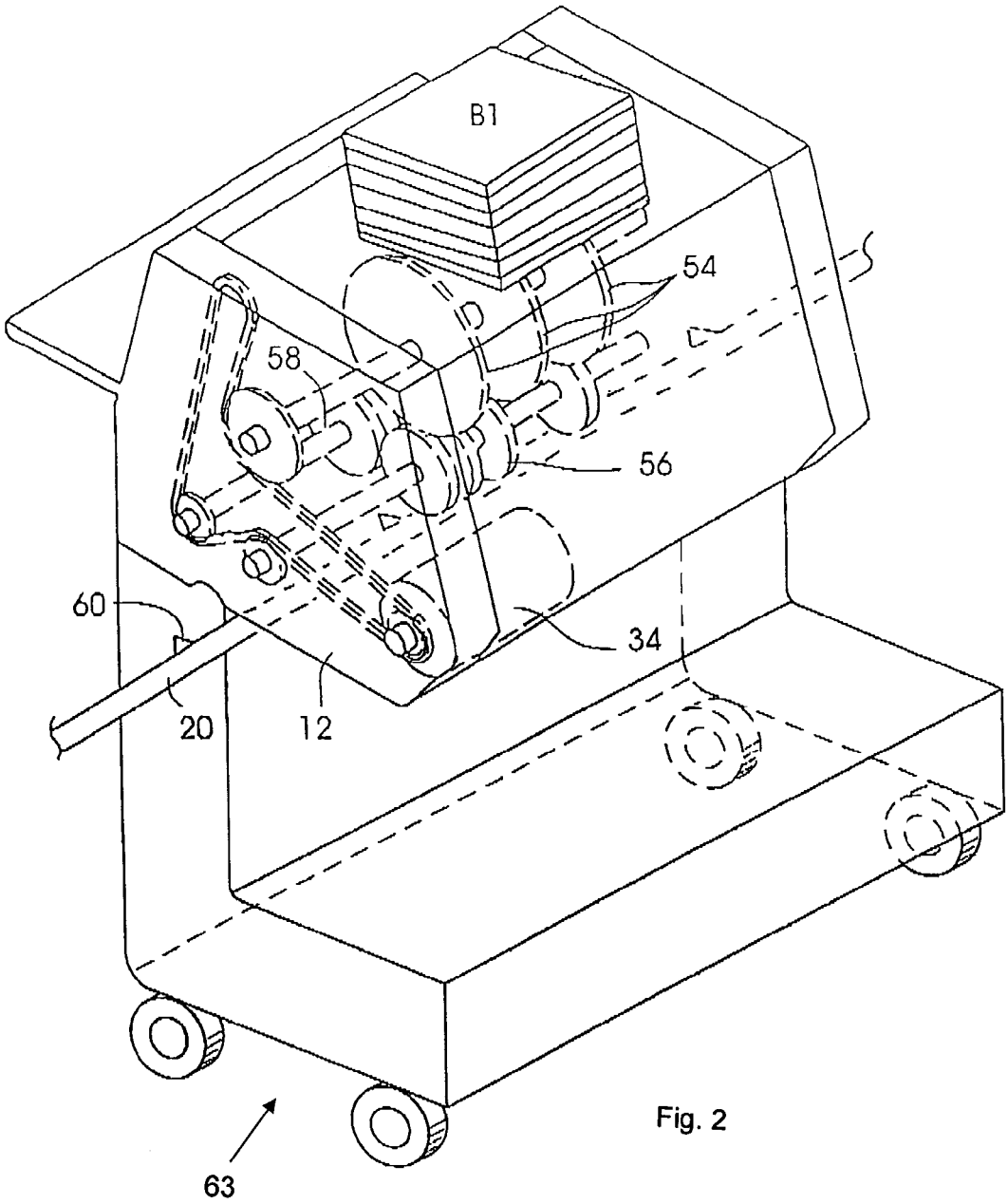
FIG. 2 is a schematic, perspective view of a folded sheet feeder including a motor of an individual drive unit according to a preferred embodiment of the present invention.

FIG. 2 shows a schematic perspective view of a folded sheet feeder, for example, the folded sheet feeder 12 of FIG. 1. The folded sheets B1 lie in a stack on the folded sheet feeder, and are individually separated by picking drums 54 and opened by opening drums 56 and 58. After being opened by the opening drums 56 and 58, a folded sheet B1 is placed on the assembly chain 20. Between leaving the opening drums 56, 58 and arriving at the assembly chain 20, the folded sheet B1 travels a distance in free fall. On the assembly chain 20, pushers 60 for the single folded sheets B1 are arranged at regular intervals. Electric motor 34 drives the picking drums 54 and the opening drums 56 via a V-belt or a chain.

Figure 3:
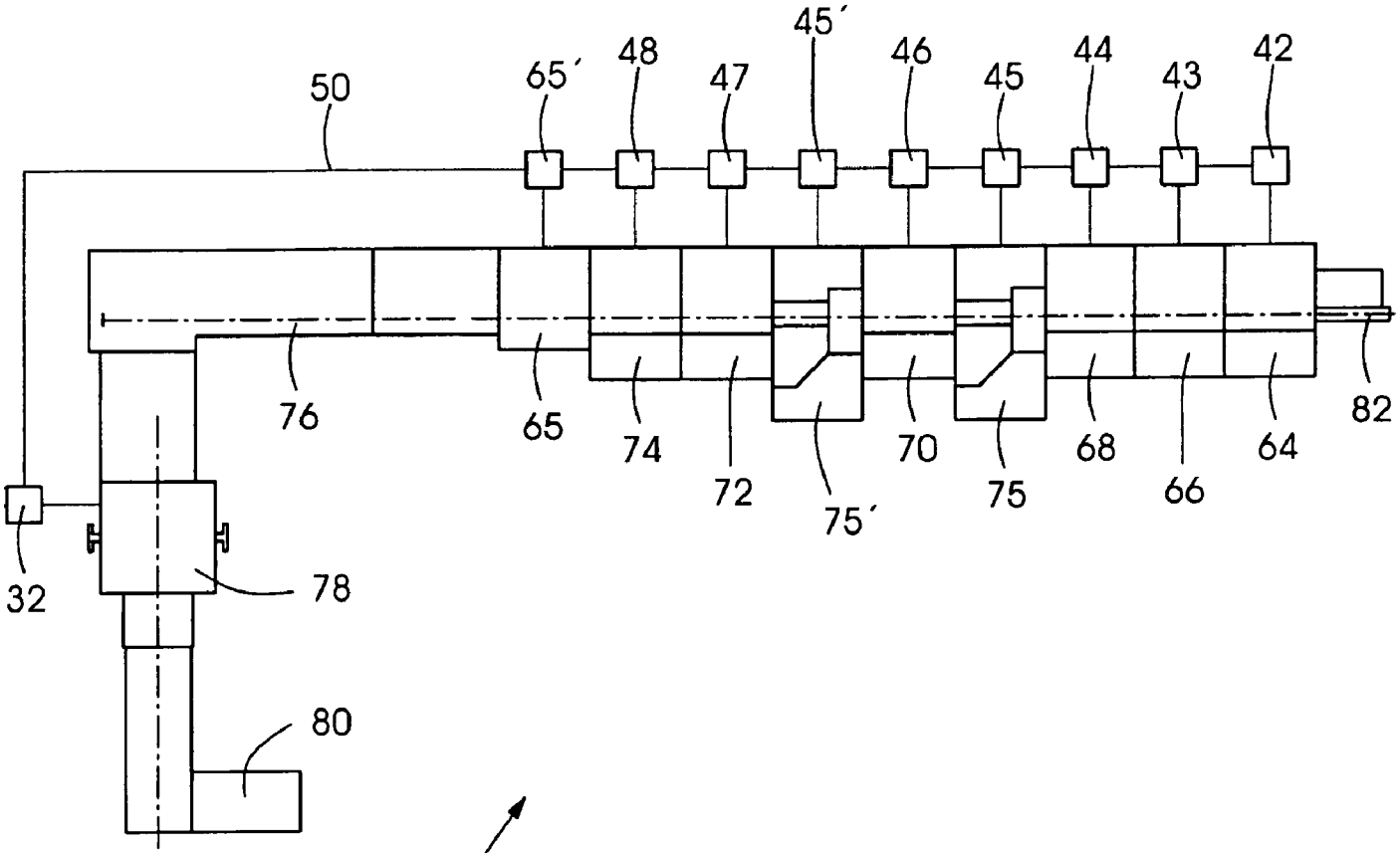
FIGS. 3–5 show various layouts of the saddle stitcher according to preferred embodiments of the present invention.

FIG. 3 shows a schematic representation of a saddle stitcher 62 according to a preferred embodiment of the present invention. The folded sheet feeders 64, 66, 68, 70, 72, 74, the stitching station 76, the trimmer 78 and the delivery 80 are preferably arranged in the shape of an L, with the direction of transport on the assembly chain being from right to left. Behind each of the folded sheet feeders 68 and 70 in the direction of transport, card gluers 75 and 75' including controllers 45 and 45' are arranged, which, when desired, glue personalized printed matter onto folded sheets which the feeder 68 has dropped onto the assembly chain 82.

Furthermore, this saddle stitcher 62 also includes a cover feeder 65 having its own controller 65'. Additional units provided with individual drives, such as one or more label dispensers (not shown), may also be provided in the saddle stitcher 62. Although FIG. 3 shows two card gluers 75 and 75', a larger number of card gluers may be arranged at any desired location along the assembly chain 82 behind any one of the folded sheet feeders 64, 66, 68, 70, 72, 74.

The controllers 45, 45' of the card gluers 75, 75' are connected via the field bus 50 to the other controllers 32, 33, 42, 43, 44, 46, 47, 48, 65' of the other units 64, 65, 66, 68, 70, 72, 74, 76, 78 of the saddle stitcher 62.

Figure 4:
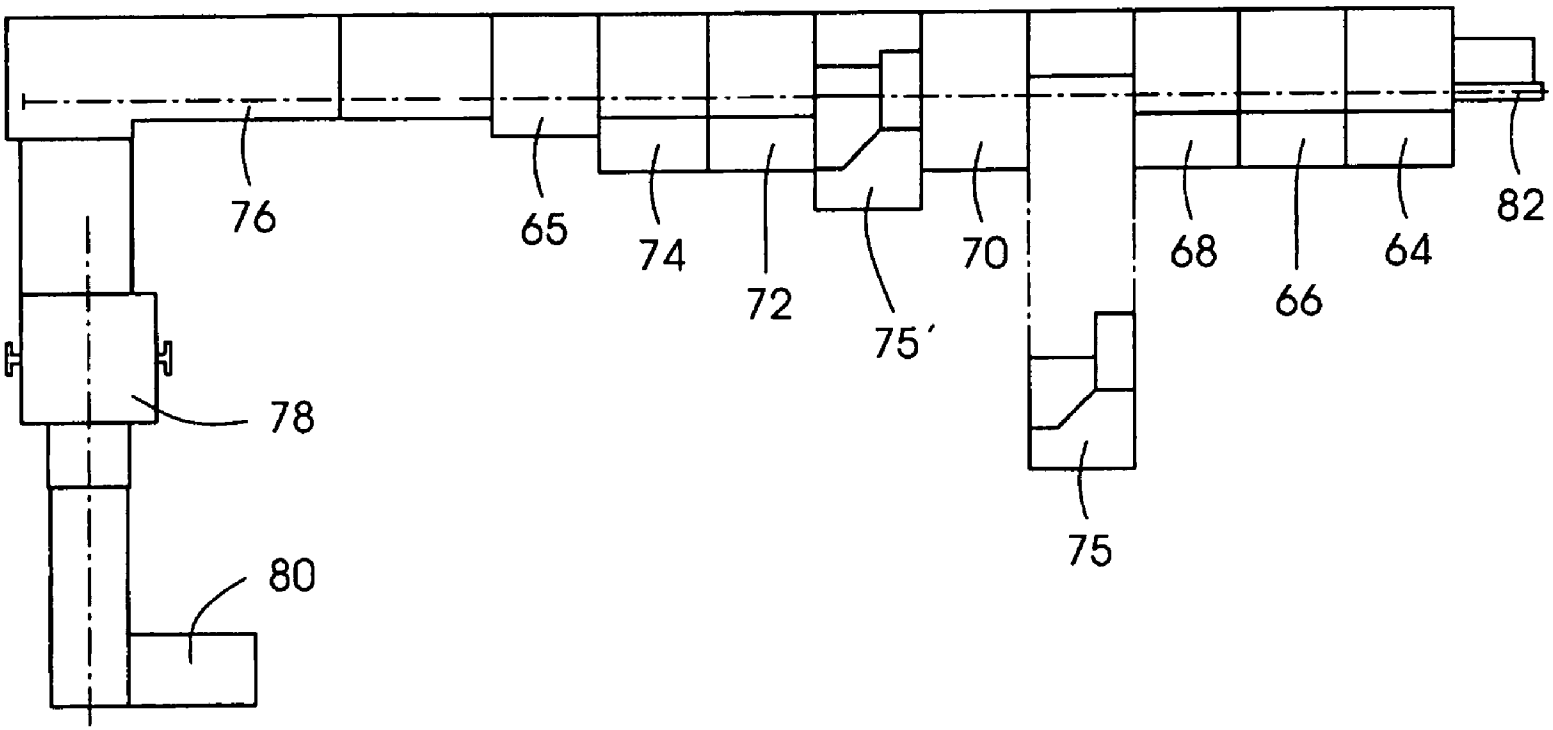

As shown in FIG. 4, at least one of the card gluers 75, 75' can be easily moved away from the assembly chain 82. For this, the card gluers 75, 75' include a conventional traveling mechanism 63 which can be locked in place as required. This facilitates switching of different card gluers 75, 75' or replacing of a folded sheet feeder 64, 66, 68, 70, 72, 74 with a card gluer 75, 75'.

Figure 5:
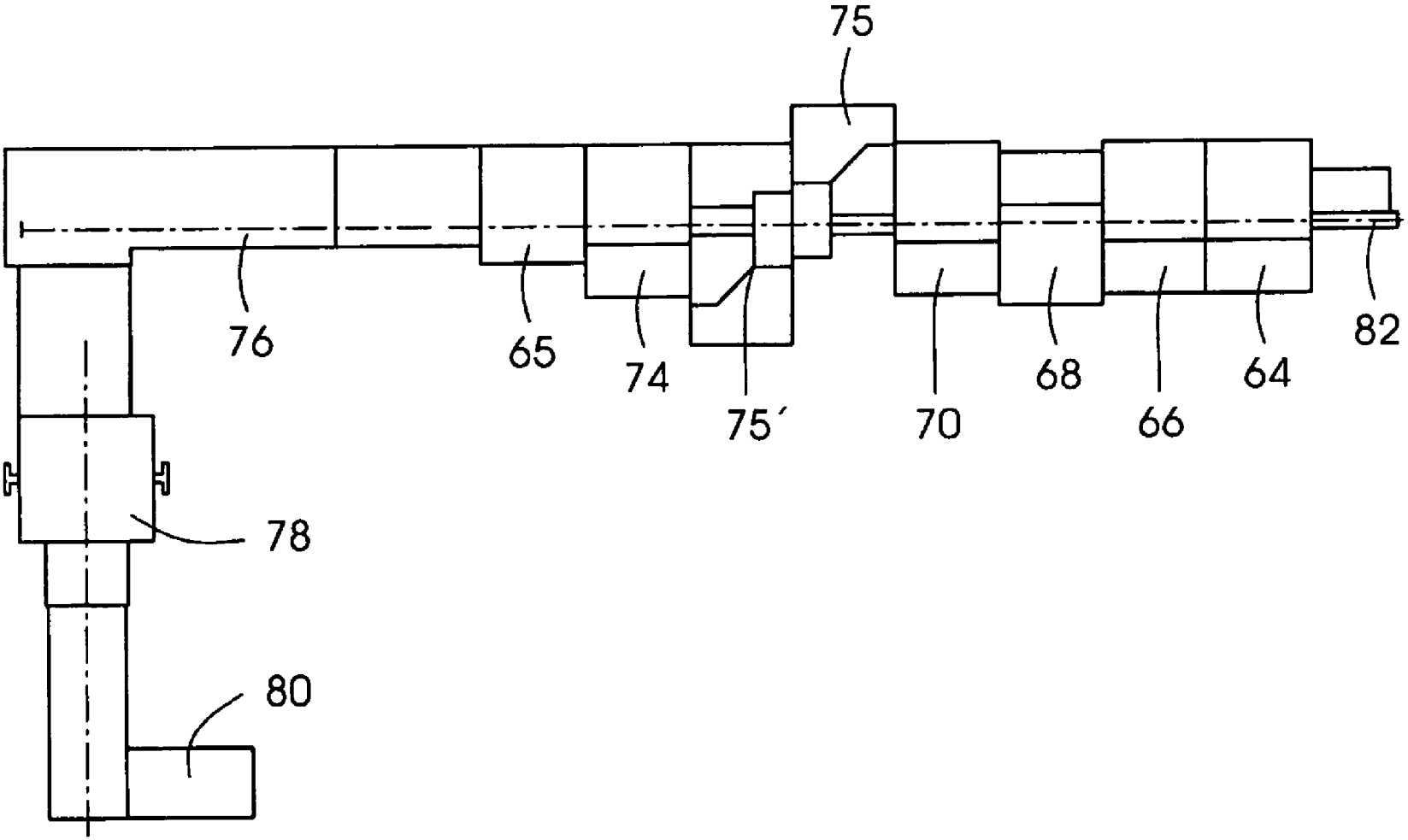

The flexibility of the layout of the saddle stitcher 62 is further clarified in FIG. 5. Since each folded sheet feeder 64, 66, 68, 70, 74 includes its own individual drive unit, each of the folded sheet feeders 64, 66, 68, 70, 74 can be rotated by 180 degrees relative to the assembly chain 82. In FIG. 5, the folded sheet feeder 68 has been rotated by 180 degrees, such that it can be loaded from the opposite side. In this manner, for example, space for a rod feeder or a label dispenser may be provided. Such a hybrid operation of folded sheet feeders with top and bottom feeding of the sheets, as depicted in FIG. 5, makes it possible to glue personalized printed matter and labels onto the front side and the back side of folded sheets, as desired. Also, the layout of the saddle stitcher can be selected and modified to conform to existing space conditions. The card gluer 75 in FIG. 5 is arranged on the opposite side of the assembly chain 82. If two card gluers 75, 75' are arranged behind a folded sheet feeder 64, 66, 68, 70, 74, as shown in FIG. 5, personalized printed matter can be glued to both sides of a dropped sheet.

In addition, conventional card gluers (not shown) include conventional sensors (not shown), which are connected to the control systems 45, 45'. These sensors monitor whether a personalized printed matter has indeed been glued on a folded sheet, and whether the personalized printed matter glued on the folded sheet is the desired personalized printed matter. For this, an index, such as a bar code printed on the personalized printed matter, is read by the sensors. The control systems 45, 45' or the central control system 32, 100 must monitor which personalized printed matter is present in the card gluers by, for example, an established sequence of personalized printed matter. Alternatively, the personalized printed matter that is glued onto an individual printed product can be manually checked to determine whether the personalized printed matter has the same or at least a coordinated index. If the sequence of personalized printed matter in the stacks of the feeders is known to the card gluers 75, 75', in the event of an incorrect gluing, the control system 32, 100 takes steps to restore the proper order of the individual card gluers 75, 75', such that only the correct personalized printed matter is glued on subsequent printed products. In one preferred embodiment of the present invention, if a first card gluer determines that the personalized printed matter was not properly glued on a folded sheet, the glue valves are closed at the following card gluers, such that the personalized printed matter is fed from the card gluers, but not glued on the folded sheets on the assembly chain 82.

Figure 6:
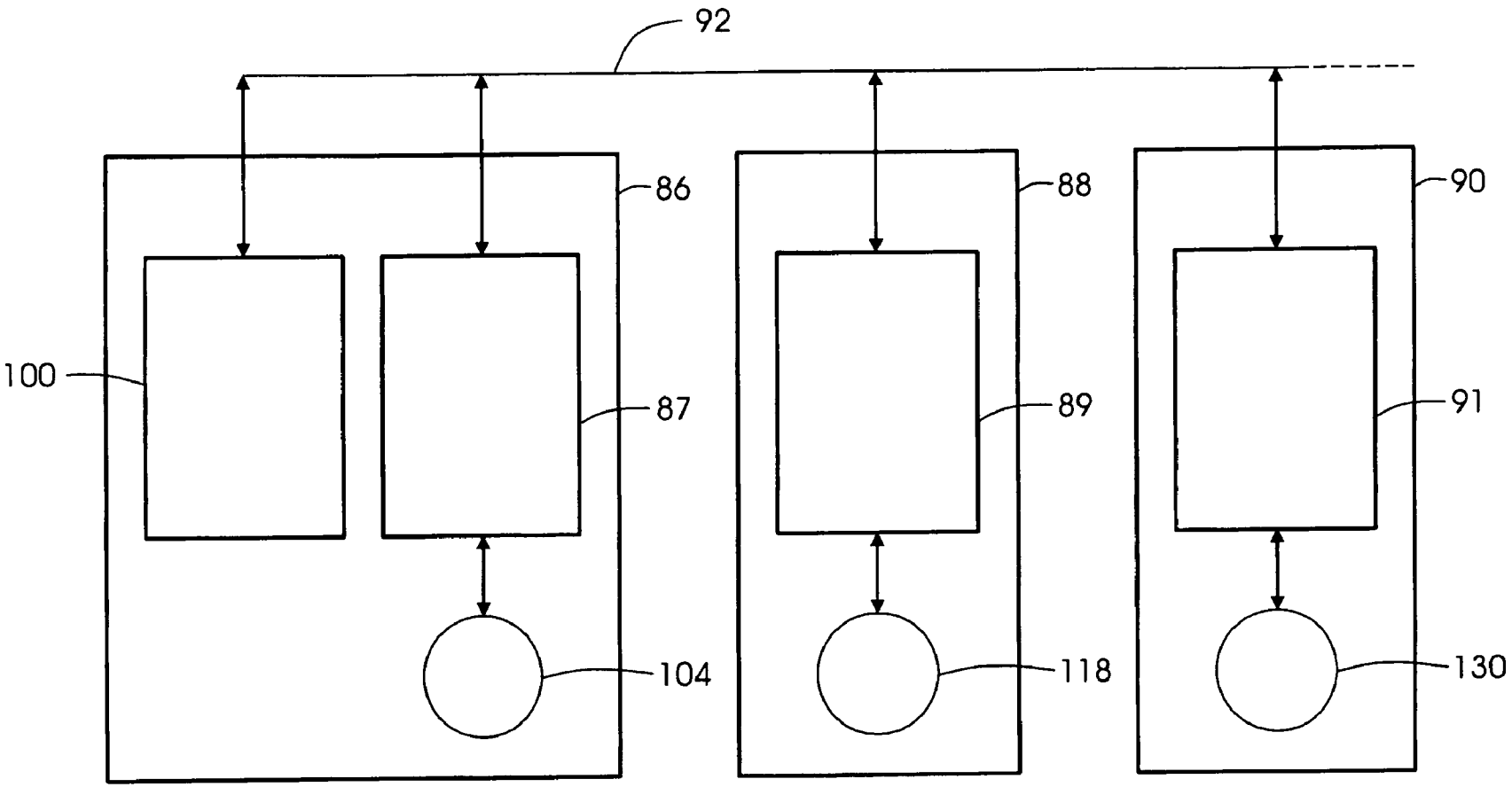
FIG. 6 is a block diagram of the drive system of a first preferred embodiment of the saddle stitcher.

The block diagram of FIG. 6 shows the drive system according to a preferred embodiment of the present invention. The drive system includes several individual drive units, e.g., a main unit 86 and two secondary units 88 and 90. Each of these individual drive units preferably includes at least one electric motor 104, 118 and 130 and a controller 87, 89, 91. The controller 87 and the controllers 89 and 91 are connected to each other via a field bus 92. Additional secondary units can be connected, as indicated by the broken line continuation of the field bus line 92. A central control system 100 is connected to the main unit and the secondary units via the field bus 92.

The main unit 86 is assigned, for example, to the stitching machine and the trimmer.

The layout of the secondary units 88 and 90, which are each coordinated with a folded sheet feeder 64, 66, 68, 70, 72, 74 or a card gluer 75, 75', is essentially identical or at least mutually compatible with each other. In this manner, the folded sheet feeders 64, 66, 68, 70, 72, 74 or card gluers 75, 75' can be interchanged.

While the present invention has been described with respect to preferred embodiments, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the present invention.

What is claimed is:

1. A saddle stitcher for producing personalized saddle stitched brochures comprising:

a stitching station;

at least two folded sheet feeders arranged to feed nonpersonalized folded sheets;

an assembly chain; a drive system; and at least two card gluers arranged along the assembly chain arranged to glue personalized printed matter onto selected ones of the nonpersonalized folded sheets; wherein the at least two card gluers are arranged to glue different ones of the personalized printed matter onto different selected ones of the nonpersonalized folded sheets.

2. The saddle stitcher according to claim 1, wherein each of the at least two folded sheet feeders includes an individual drive unit.

3. The saddle stitcher according to claim 2, wherein the individual drive units are each assigned to one of the at least two folded sheet feeders and one of the at least two card gluers, and jointly or individually to the stitching station and the assembly chain.

4. The saddle stitcher according to claim 2, wherein each individual drive unit includes at least one electric motor, at least one controller and a connection for exchanging at least one of data and control signals between the controllers.

5. The saddle stitcher according to claim 4, wherein at least one of the at least two card gluers is synchronized via the connection for exchanging of data and control signals with the drive system of the saddle stitcher.

6. The saddle stitcher according to claim 4, wherein the controller of the individual drive unit of at least one of the at least two card gluers is configured such that the speed of the card gluer can be adjusted to speed changes of the saddle stitcher.

7. The saddle stitcher according to claim 4, wherein the controller of the individual drive unit of at least one of the at least two card gluers is configured such that the location for dispensing the personalized printed matter on the folded sheet can be adjusted and fine tuned by a controlled rotary angle offset.

8. The saddle stitcher according to claim 4, wherein the controller of the saddle stitcher includes a sequential feeder monitoring device, and at least one of the at least two card gluers is in communication with the sequential feeder monitoring device.

9. The saddle stitcher according to claim 1, wherein the at least two folded sheet feeders are configured so as to be rotatable by 180 degrees relative to the assembly chain.

10. The saddle stitcher according to claim 1, wherein the at least two card gluers are configured so as to be rotatable by 180 degrees relative to the assembly chain.

11. The saddle stitcher according to claim 1, wherein at least one of the at least two folded sheet feeders and the at least two the card gluers includes a traveling mechanism for moving and fixing the at least one of the at least two folded sheet feeders and the at least two the card gluers.

12. The saddle stitcher according to claim 1, wherein the saddle stitcher includes a central controller.

13. The saddle stitcher according to claim 12, wherein the central controller is connected to the controllers of the individual drive units of the at least two folded sheet feeders and the at least two card gluers for the exchanging data and control signals.

14. The saddle stitcher according to claim 12, wherein the central controller of the saddle stitcher actuates the at least two card gluers such that all cards glued into a brochure are identically personalized.

15. The saddle stitcher according to claim 1, wherein a checking unit is provided behind each of the at least two card gluers in a transport direction of the folded sheets, by which the gluing of each personalized printed matter is checked.

16. The saddle stitcher according to claim 15, wherein a rejecting device is provided, by which the brochures lacking a personalized printed matter are rejected.

17. A method for producing personalized saddle stitched brochures, comprising the steps of:

a) feeding a first nonpersonalized folded sheet via a folded sheet feeder;

b) placing the first nonpersonalized folded sheet on an assembly chain;

c) activating a card gluer, when a first personalized printed matter is to be glued onto the first nonpersonalized folded sheet, so as to glue the first personalized printed matter onto the first nonpersonalized folded sheet;

d) checking whether the first personalized printed matter has been glued onto the first nonpersonalized folded sheet;

e) feeding a second nonpersonalized folded sheet via another folded sheet feeder;

f) activating another card gluer, when a second personalized printed matter is to be glued onto the second nonpersonalized folded sheet, so as to glue the second personalized printed matter onto the second nonpersonalized folded sheet;

g) checking whether the second personalized printed matter has been glued onto the second nonpersonalized folded sheet;

h) repeating steps e) to g) until a complete personalized brochure has been assembled; and i) saddle stitching the complete personalized brochure.

18. The method according to claim 17, further comprising the step of: j) side cutting of the saddle stitched completed personalized brochure.

19. The method according to claim 17, further comprising the steps of: k) checking, after each gluing of a personalized printed matter, to make sure that the personalized printed matter was glued on the nonpersonalized folded sheets; and l) rejecting the product if the personalized printed matter has not been.

20. The method according to claim 17, further comprising the step of: m) checking whether only identically personalized printed matter have been glued into the complete personalized brochure.

21. The method according to claim 20, further comprising the step of: n) discarding defective products.

* * * * *